United States Patent [19]

Parenti et al.

[11] Patent Number: 5,001,800

[45] Date of Patent: Mar. 26, 1991

[54] AUTOMATIC, SELF-PROPELLED CLEANER FOR SWIMMING POOLS

[75] Inventors: Giorgio Parenti; Ercole Frattini, both of Varese, Italy

[73] Assignee: Egatechnics S.r.L., Varese, Italy

[21] Appl. No.: 371,428

[22] Filed: Jun. 26, 1989

[30] Foreign Application Priority Data

Jun. 28, 1988 [IT] Italy ..... 21130 A/88

[51] Int. Cl.[5] ..... E04H 3/20

[52] U.S. Cl. ..... 15/1.7; 15/387

[58] Field of Search ..... 15/1.7, 387; 134/18

[56] References Cited

U.S. PATENT DOCUMENTS 3,790,979 2/1974 Foster ..... 15/1.7

4,560,418 12/1985 Raubenheiner ..... 15/1.7 X

FOREIGN PATENT DOCUMENTS 2904464 8/1979 Fed. Rep. of Germany ..... 15/1.7

2584442 1/1987 France ..... 15/1.7

*Primary Examiner*—Edward L. Roberts

*Attorney, Agent, or Firm*—Notaro & Michalos

[57] ABSTRACT

An automatic, self-propelled cleaner comprises a hydraulic turbine motor for driving two oppositely located wheel Locomotion members and at least one cam driven by the motor and associated with one of the wheel locomotion members to temporarily riase it while the other of the wheel Locomotion members is held engaged, thereby the travel direction of the cleaner can be changed.

17 Claims, 4 Drawing Sheets

AUTOMATIC, SELF-PROPELLED CLEANER FOR SWIMMING POOLS

FIELD AND BACKGROUND OF THE INVENTION

This invention relates to an automatic, self-propelled swimming pool cleaner.

Cleaners of this kind fall basically into two major classes: electrically operated cleaners and hydraulically operated cleaners.

A common requirement to both cleaner classes is that they should allow for changes in their travel paths across the pool bottom and side walls such that the whole pool surface can be cleaned.

In addition, the cleaner is to readily go over such obstacles as edges, corners, fittings, and any other surface discontinuities met on the pool surfaces being cleaned.

Examples of hydraulically operated cleaners are described in U.S. Pat. No. 4,560,418 and German Patent No. 2612043. Examples of electrically operated cleaners are described in European Patent No. 257006 and French Patent Application No. 2584442.

Electric cleaners benefit, in comparison with hydraulic cleaners, from more convenient handling of their directional control because changes in direction and deviations from a set travel path can be programmed through electric signals sent to the cleaner drive motors. On the other hand, their construction is more complex than that of hydraulic cleaners, and watertight compartments must be arranged for their electric components.

Irrespective of how easily the directional control of electric cleaners can be provided, if the program that handles such control cannot be altered by the user, it may occur that a preset control routine fails to fit different pool designs.

For these and other reasons, fully hydraulically operated cleaners have met widespread commercial acceptance despite their lower flexibility.

Among the reasons for such acceptance is that the foul matter removed by the cleaner is at once taken away from the pool and collected in the main filtering system, which affords increased range for the cleaner and fully safe operation thereof, as well as decreased cost.

SUMMARY OF THE INVENTION

The problem that underlies this invention is to provide an automatic cleaner for swimming pools which is so designed and constructed as to combine all the advantages of hydraulically operated cleaners, while affording a thorough cleaning action all over the submerged surfaces of a swimming pool, and to be drivable over edges and corners and along irregular paths.

The invention is also directed to provide a cleaner having a directional control system which can be tailored to suit specific demands, by the user himself.

The above problem is solved, according to the invention, by an automatic, self-propelled cleaner for swimming pools being characterized in that it comprises a hydraulic turbine motor for one-way driving two oppositely located wheel locomotion members and at least one cam driven by the motor and associated with one of said locomotion members to temporarily raise it while the other locomotion member is held in engagement, thereby the travel direction of the cleaner can be changed.

Advantageously, the cam would be keyed releasably to a shaft driven by said motor externally of the body of said cleaner.

BRIEF DESCRIPTION OF THE DRAWINGS

The features and advantages of this invention will become more clearly apparent from the following detailed description of a preferred, but not exclusive, embodiment thereof, to be raken by way of illustration and not of limitation in conjunction with the accompanying drawings, where.

DESCRIPTION OF THE PREFERRED EMBODIMENT

Figure 1:
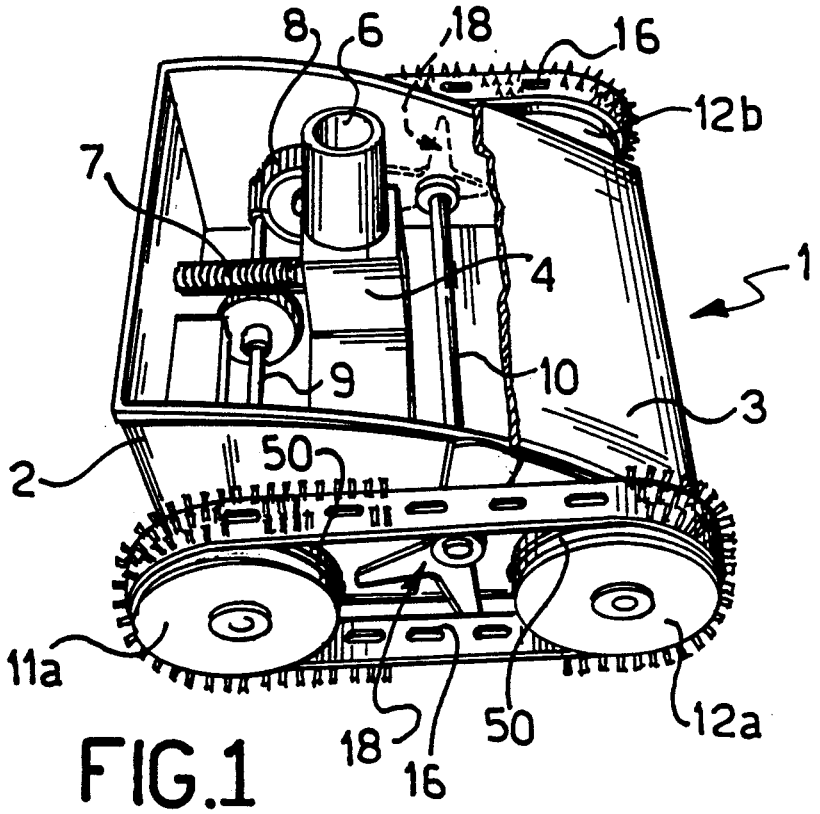
FIG. 1 is a perspective view from above of a cleaner embodying this invention.

An automatic, self-propelled swimming pool cleaner is generally indicated at 1 throughout the drawing views.

The cleaner 1 comprises a body 2 which is closed at the top by a detachable cover 3 and accommodates a hydraulic turbine motor 4 on its interior.

The bottom wall 2*a* of the body 2 is provided with a suction fitting 5 for the motor 4. A manifold 6 extends across the cover 3 to direct the discharge flow passed through the motor 4.

Fitted releasably to the manifold 6 is a flexible pipe, not shown, through which the cleaner 1 is connected to the strainer system of a swimming pool at the so-called skimmer fitting.

The motor 4 drives, via a worm reduction gear 7 and a gear train 8, first and second shafts, respectively indicated at 9 and 10.

Keyed to the opposed ends of the first shaft 9 are two drive wheels 11*a*, 11*b* and two corresponding wheels 12*a*, 12*b* are keyed to the ends of an idler shaft 13 borne frontally on the body 2. All the wheels have a raised circumferential rib 50 formed at a substantially central location thereon.

Stretched between each wheel pair 11*a*, 12*a* and 11*b*, 12*b* is an elastic track 14, e.g. made of rubber, which is formed with a plurality of flexible outwardly projecting lugs 15 and slots 16. The slots 16 are aligned along the central portion of the track 14 to the ribs 50, thereby the track is weakened locally and held centered on the wheels.

Reference will be made herein below to the combination of each wheel pair 11*a*, 12*a* and 11*b*, 12*b* and respective track 14 as the "wheel locomotion member".

Keyed to at least one axial end, preferably both ends, of the shaft 10 is a cam having multiple cam lobes 18*a*, 18*b*, 18*c* which may have different camming profiles from one another.

The provision of two cams prevents kinking of the flexible pipe connected to the manifold 6. However, a single cam would still ensure operability of the cleaner 1, as explained herein below.

The cam 18 is held releasably on the shaft 10 by a thumbscrew 19; is made rotatively rigid with the shaft 10, and is accessible from the body 2 outside for quick replacement with no further disassembling of the cleaner 1.

A brush 20 is mounted in a tiltable manner on the front portion of the body 2. For this purpose, the brush 20 is provided with an axial shaft 21 having its ends connected to the idler shaft 13 by connecting rods 22.

The brush 20 is driven rotatively via a gear train 23 which connects the shaft 21 to the shaft 13 and, through the latter, to one of the wheels 12*a*, 12*b*.

This cleaner 1 operates as follows.

By connecting the manifold 6 through the aforesaid flexible pipe to the skimmer fitting of the swimming pool, a flow of water is caused to be drawn through the fitting 5 and the hydraulic turbine motor 4.

The flow of water thus drawn in, rotates the turbine of the motor 4, and hence the worm reduction gear 7 and gear train 8.

The reduction gear 7 rotatively drives the shaft 9 directly, and consequently, the wheels 11*a*, 11*b*; through the gear train 8, the shaft 10 and the cams 18 keyed thereto are also rotated at a reduced speed relatively to the shaft 9.

Figure 2:
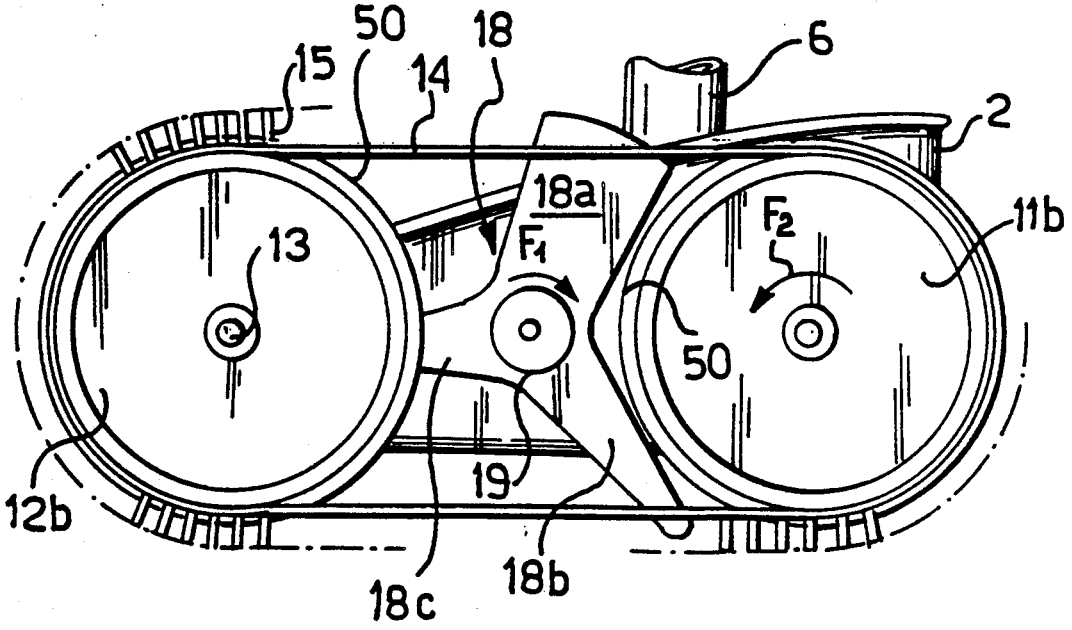
FIG. 2 is a side elevation view of the cleaner shown in FIG. 1.
Figure 1A:
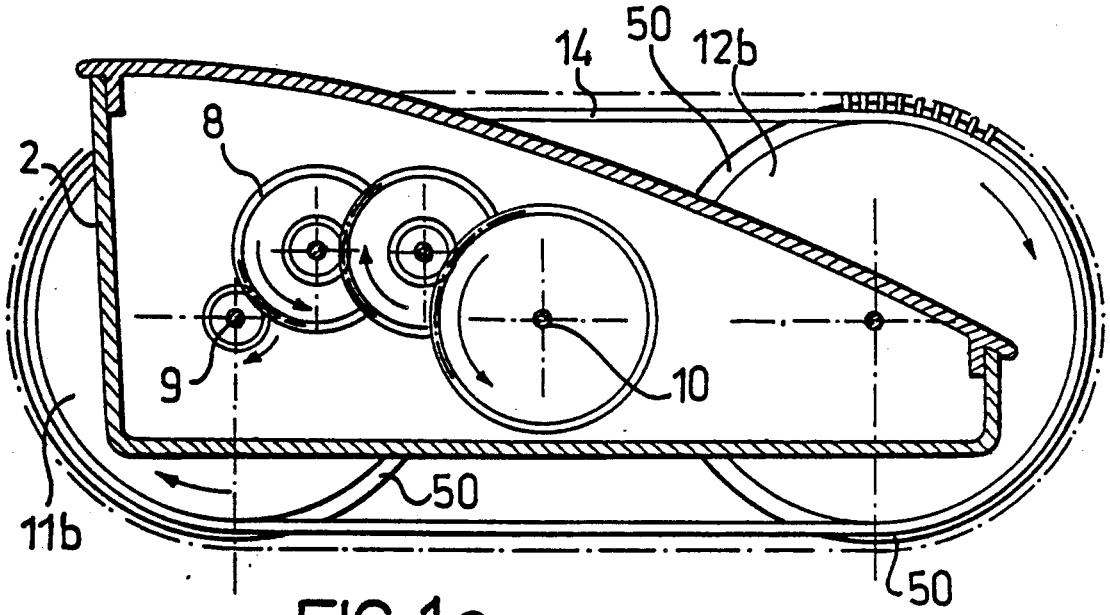
FIG. 1*a* is a sectional view of the cleaner in FIG. 1, illustrating a gear train for propelling the cleaner.
Figure 1B:
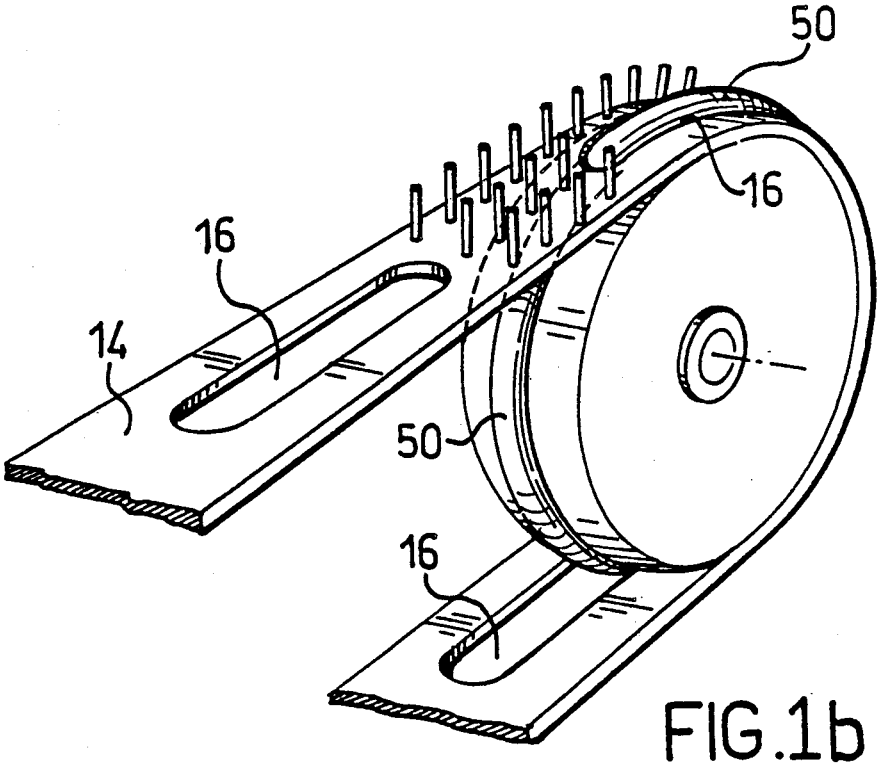
FIG. 1*b* is a partial perspective view of an elastic track and wheel for the cleaner.
Figure 3:
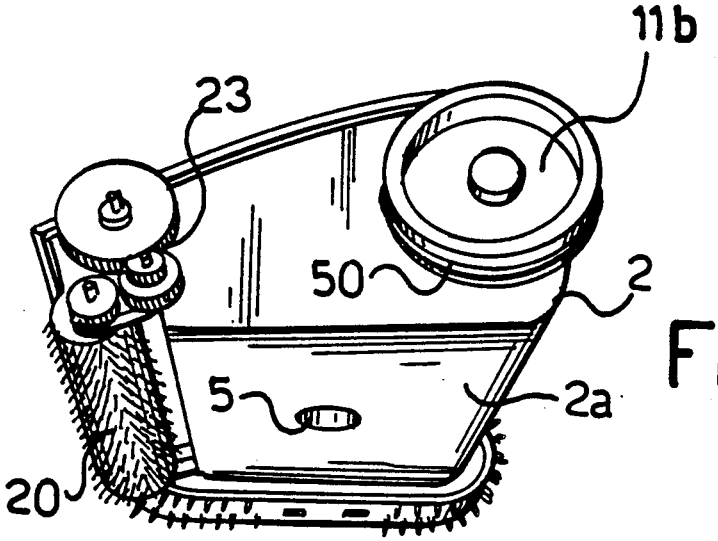
FIGS. 3 and 4 are a perspective bottom view and longitudinal sectional views, respectively, of a detail of the cleaner shown in the preceding Figures.
Figure 4:
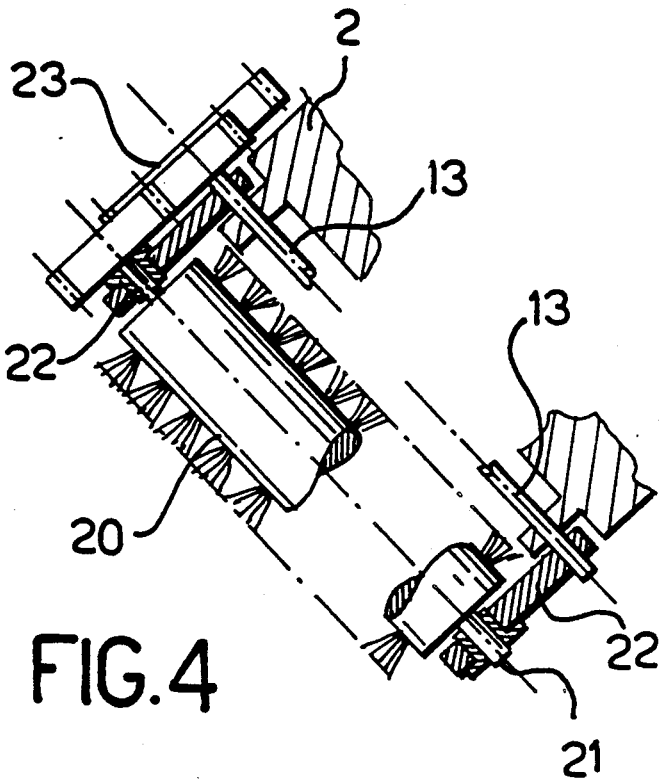

The direction of rotation of the cam 18, as indicated by an arrow F1 in FIG. 2, is opposite from the direction of rotation of the wheels 11*a*, 11*b*, as indicated by an arrow F2 in the same Figure.

During the rotation of the cam 18, the cam lobes 18*a*, 18*b*, 18*c* will sequentially contact the pool surface being cleaned and raise the wheel locomotion member located on the cam 18 side off said surface for a time duration which is dependent on the radial dimension of the lobe 18*a*, 18*b*, 18*c* and its shape, as well as on the rotational speed of the cam 18.

Thus, the cleaner 1 becomes restrained at the side where a cam lobe bears on the surface being cleaned, whereas the opposite locomotion member, being held in contact with said surface, is still driving forward, thereby the cleaner will be forced into a pivotal movement about the lobe of the cam 18. This pivotal movement is further enhanced by the opposite rotation of the cam 18 relatively to the direction of rotation of the wheels and by the flexibility of the lugs 15, which will deform elastically during the cleaner 1 pivoting to counteract possible sideward forces tending to disentangle the tracks 14.

The suction applied through the fitting 5 is assisted by the mechanical action of the brush 20 which effectively removes foul matter clinging to the pool surfaces.

Figure 7:
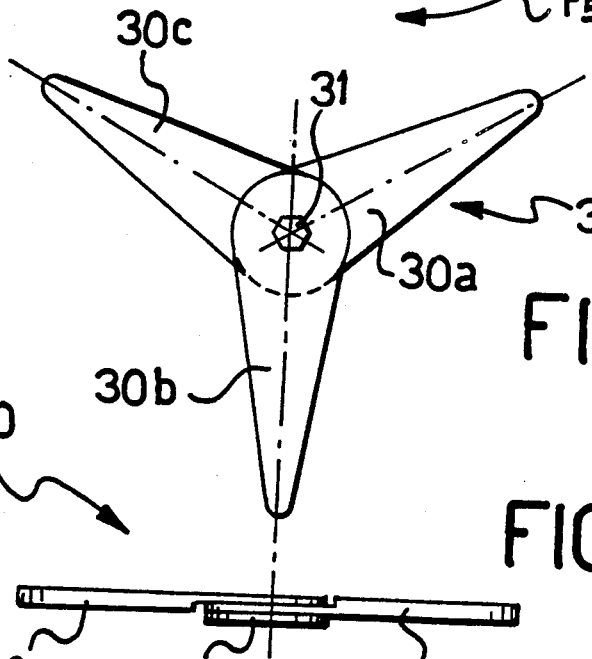
FIGS. 7 and 8 are side elevation and top plan views, respectively, of a second embodiment of the detail shown in FIG. 6.
Figure 8:
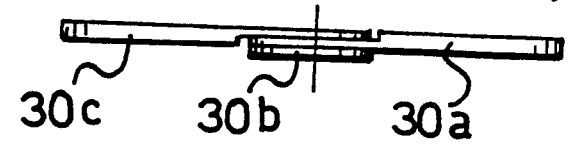

The frequency of the changes in direction of the cleaner 1 and the extent of the angular travel path deviations can be readily varied by suitably altering the profile of the cam 18. For this purpose, shown in FIGS. 7 and 8 is an assembly cam, generally indicated at 30, which includes three stacked lobes 30*a*, 30*b*, 30*c* into a pack-like configuration which can be locked on the shaft 10 by means of the thumbscrew 19.

Preferably, the shaft 10 would have, at least in the cam 30 keying region, a polygonal cross-section shape, e.g. a hexagonal shape, wherewith the three lobes are engaged by means of mating holes 31 having an identical cross-sectional shape.

The vacuum generated beneath the body 2 by the suction flow through the fitting 5 is adequate to ensure adhesion of the cleaner 1 not only to the pool bottom but also to the upright (or in all cases, steep) side walls of the same.

In cleaning such upright side walls, it may occur that the machine reaches, while in a vertical trim condition, the water free surface and comes out of the water by a few centimeters, until the buoyancy and drive forces equal the weight of the cleaner 1. Under that condition, the adhesion of the locomotion members to the wall surface of the swimming pool would be insufficient to permit of the normal pivoting of the machine (FIG. 5), and to obviate this brawback, a different cam design has been provided, as shown in FIG. 6.

Figure 6:
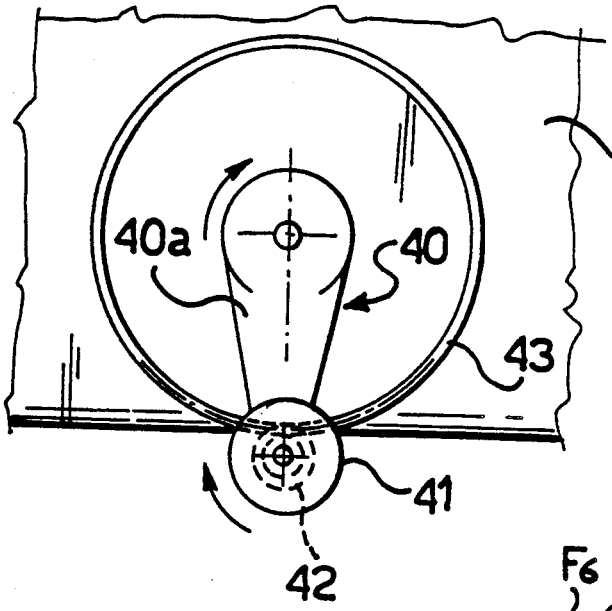
FIG. 6 shows a first embodiment of a detail of the cleaner according to the preceding Figures.

In FIG. 6, this modified embodiment of the cam is generally indicated at 40 and has a single cam lobe 40*a*, it being understood that the cam 40 may include multiple angularly spaced lobes similarly to the cam 30.

The free end of the lobe 40*a* carries a small wheel 41 which has a pinion gear 42 formed integrally therewith. The pinion gear 42 is in mesh-engagement with a gear 43 made rigid with the body 2 such that, as the lobe 40*a* is rotated, the wheel 41 will be rotated about its own axis in the same direction as the cam 40.

Alternatively, a cam, not shown, may be provided which has, on the free end of its lobes, a small wheel allowed to turn freely in the opposite direction of rotation from the forward travel direction of the cleaner 1 but restrained from rotation in the other direction, such as by providing it with a conventional freewheel mechanism.

Figure 5:
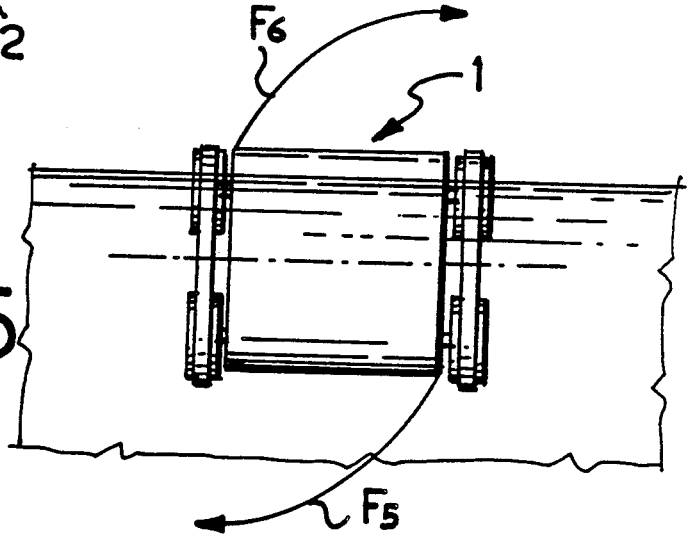
FIG. 5 illustrates in schematic form a particular condition of operation of this cleaner.

Thus, with the cleaner 1 in the stalled condition shown in FIG. 5, and the cam 40 engaging a side wall of the pool, one side of the cleaner 1 will be pulled downwards (arrow F5) by the tractive action of the wheel 41, or by its own weight with the wheel freely rotating if equipped with a freewheel mechanism, thereby raising its corresponding locomotion member off the wall surface. The other locomotion member will remain submerged and will be able to drag the cleaner 1 in the direction of the arrow F6.

On the cleaner 1 arriving at the bottom of an upright wall to start climbing it, the wheels 11*a*, 11*b* will have a different instantaneous rotational speed from the rotational speed of the wheels 12*a*, 12*b*. This rotational speed differential is accommodated by the elasticity of the tracks 14, also by virtue of the slots 16 provided and of the resiliency of the lugs 15.

The cleaner of this invention affords a number of advantages over prior cleaners.

First of all, being powered throughout by a hydraulic turbine, it requires no electrical hook-ups and watertight compartments, so that it will be free of any relevant constructional complications.

Further, the track locomotion members enable it to get over bumps and surface irregularities of the swimming pool, while making it easier for the cleaner 1 to negotiate blind spots at corners or along twisting travel paths.

In addition, the program that controls the cleaner changes of direction can be varied at will by the operator using very simple means (it is sufficient that the cam be replaced or that its lobes be given different angular settings) and without involving any disassembling of cleaner parts.

A range of directional control programs can be manufactured at very low costs on account of the inherently simple construction of the cams.

We claim:

1. An automatic self-propelled swimming pool cleaner comprising, a housing body with a bottom wall and a counterposed pair of side walls, adapted to be moved along a surface of the pool to be cleaned, an opening in the bottom wall, a hydraulic turbine motor mounted in said housing and having a casing which is connected to a tubular suction conduit attaching manifold, a gear train connected to said hydraulic turbine motor, two oppositely located locomotion members journalled to the housing side walls and actuated by said motor via said gear train, said locomotion members being for contact with the surface of the pool, a cam shaft journalled to the housing and having a free end extending through at least one of the side walls of the housing with the free end being adjacent one of said locomotion members, said cam shaft being connected to and driven by said gear train, a cam member mounted on the free end of said shaft and rotating therewith, said cam member being provided with a profile having an operative portion which periodically contacts the surface of the swimming pool as the cam shaft rotates whereby the one of said locomotion members is raised from the surface while the other opposite locomotion member is in contact with the surface.

2. An automatic self-propelled swimming pool cleaner according to claim 1, in which said gear train is formed so that the direction of rotation of said cam shaft is opposite to the direction of rotation of said locomotion members.

3. An automatic self-propelled swimming pool cleaner according to claim 1, in which said gear train is formed so that the speed of rotation of said cam shaft is less than the speed of rotation of said locomotion members.

4. An automatic self-propelled swimming pool cleaner comprising, a housing body with a bottom wall and a counterposed pair of side walls, adapted to be moved along a surface of the pool to be cleaned, an opening in the bottom wall, a hydraulic turbine motor mounted in said housing and having a casing which is connected to a tubular suction conduit attaching manifold, a gear train, connected to said hydraulic turbine motor, two oppositely located locomotion members journalled to the housing side walls and actuated by said motor via said gear train, said locomotion members being for contact with the surface of the pool, a cam shaft journalled to the housing and having a free end extending through at least one of the side walls of the housing with the free end being adjacent one of said locomotion members, said cam shaft being connected to and driven by said gear train, a cam member mounted on the free end of said shaft and rotating therewith, said cam member being provided with a plurality of lobes each having a free end for contact with the surface of the swimming pool whereby the one of said locomotion members is periodically raised from the surface while the other opposite locomotion member is in contact with the surface.

5. An automatic self-propelled swimming pool cleaner according to claim 4, in which said gear train is formed so that the direction of rotation of said cam shaft is opposite to the direction of rotation of said locomotion members.

6. An automatic self-propelled swimming pool cleaner according to claim 4, in which said gear train is formed so that the speed of rotation of said cam shaft is less than the speed of rotation of said locomotion members.

7. An automatic self-propelled swimming pool cleaner comprising, a housing body with a bottom wall and a counterposed pair of side walls, adapted to be moved along a surface of the pool to be cleaned, an opening in the bottom wall, a hydraulic turbine motor mounted in said housing and having a casing which is connected to a tubular suction conduit attaching manifold, a gear train connected to said hydraulic turbine motor, two oppositely located locomotion members journalled to the housing side walls and actuated by said motor via said gear train, said locomotion members being for contact with the surface of the pool, a cam shaft journalled to the housing and having a free end extending through at least one of the side walls of the housing with the free end being adjacent one of said locomotion members, said cam shaft being connected to and driven by said gear train, a cam member mounted on the free end of said shaft and rotating therwith, said cam member comprising a plurality of lobes which are structurally independent of and angularly shiftable relatively to one another in their mounting engagement with said cam shaft, a free end of each of said lobes having an operative portion which contacts the surface of the swimming pool whereby the one of said locomotion members is periodically raised from the surface while the other opposite locomotion member is in contact with the surface.

8. An automatic self-propelled swimming pool cleaner according to claim 7, in which said gear train is formed so that the direction of rotation of said cam shaft is opposite to the direction of rotation of said locomotion members.

9. An automatic self-propelled swimming pool cleaner according to claim 7, in which said gear train is formed so that the speed of rotation of said cam shaft is less than the speed of rotation of said locomotion members.

10. An automatic self-propelled swimming pool cleaner comprising, a housing body with a bottom wall and a counterposed pair of side walls, adapted to be moved along a surface of the pool to be cleaned, an opening in the bottom wall, a hydraulic turbine motor mounted in said housing and having a casing which is connected to a tubular suction conduit attaching manifold, a gear train connected to said hydraulic turbine motor, two oppositedly located locomotion members journalled to the housing side walls and actuated by said motor via said gear train, said locomotion members being for contact with the surface of the pool, a cam shaft journalled to the housing and having a free end extending through at least one of the side walls of the housing with the free end being adjacent one of said locomotion members, said cam shaft being connected to and driven by said gear train, a cam member mounted on the free end of said shaft and rotating therewith, said cam member comprising a plurality of lobes which are structurally independent of and angularly shiftable relatively to one another in their mounting engagement with said cam shaft, said lobes each having a respective free end, a stationary gear concentric to said cam shaft and fixed to the side wall of the housing body, a roller journalled at the free end of each of the lobes of said cam member, a pinion gear rigidly fixed to each of said rollers and in engagement with an outer periphery of said stationary gear, so that each of said rollers rotates around its own axis when said cam member is caused to rotate.

11. An automatic self-propelled swimming pool cleaner according to claim 10, in which said gear train is formed so that the direction of rotation of said cam shaft is opposite to the direction of rotation of said locomotion members.

12. An automatic self-propelled swimming pool cleaner according to claim 10, in which said gear train is formed so that the speed of rotation of said cam shaft is less than the speed of rotation of said locomotion members.

13. An automatic self-propelled swimming pool cleaner comprising, a housing body with a bottom wall and a counterposed pair of side walls, adapted to be moved along a surface of the pool to be cleaned, an opening in the bottom wall, a hydraulic turbine motor mounted in said housing and having a casing which is connected to a tubular suction conduit attaching manifold, a gear train connected to said hydraulic turbine motor, two oppositedly located locomotion members journalled to the housing side walls and actuated by said motor via said gear train, said locomotion members each comprising a pair of wheels one of which is driven by said gear train, and a track stretched and trained around the periphery of each pairs of wheels, said track being for contact with the surface of the pool, a cam shaft journalled to the housing and having a free end extending through at least one of the side walls of the housing with the free end being adjacent one of said locomotion members, said cam shaft being connected to and driven by said gear train, a cam member mounted on the free end of said shaft and rotating therewith, said cam member being provided with a profile having an operative portion which periodically contacts the surface of the swimming pool as the cam shaft rotates whereby the one of said locomotion members is raised from the surface while the other opposite locomotion member is in contact with the surface.

14. An automatic self-propelled swimming pool cleaner according to claim 13, in which said gear train is formed so that the direction of rotation of said cam shaft is opposite to the direction of rotation of said locomotion members.

15. An automatic self-propelled swimming pool cleaner according to claim 13, in which said gear train is formed so that the speed of rotation of said cam shaft is less than the speed of rotation of said locomotion members.

16. An automatic self-propelled swimming pool cleaner according to claim 13, in which each of said wheels of the locomotion members are provided with a circumferencial rib formed at a central location of a periphery of each wheel.

17. An automatic self-propelled swimming pool cleaner according to claim 16, in which said track of each locomotion member comprises an elastically deformable material and is provided with a plurality of a longitudinally extending slots parallel to a direction of movement of the track and aligned with said rib of the wheels.

* * * * *